United States Patent [19]

Hellstrom

[11] 3,942,640

[45] Mar. 9, 1976

[54] TEAR-AWAY BLISTER PACKAGE

[76] Inventor: Harold Richard Hellstrom, 5245 Center Ave., Pittsburgh, Pa. 15232

[22] Filed: Feb. 27, 1974

[21] Appl. No.: 446,428

Related U.S. Application Data

[63] Continuation-in-part of Ser. No. 269,752, July 7, 1972, abandoned.

[52] U.S. Cl. ..... 206/469; 206/461; 206/470; 206/484

[51] Int. Cl.[2] ..... B65D 73/00

[58] Field of Search ..... 206/461, 467, 469, 470, 206/484, 365, 379, 441

[56] References Cited

UNITED STATES PATENTS

| | | | |
|---|---|---|---|
| 2,892,538 | 6/1959 | Middleton, Jr. et al. | 206/469 |
| 3,288,280 | 11/1966 | Bostrom | 206/461 |
| 3,335,939 | 8/1967 | Robinson, Jr. | 229/43 |
| 3,454,210 | 7/1969 | Spiegel et al. | 229/43 |
| 3,476,239 | 11/1969 | Jacob | 206/461 |

*Primary Examiner*—William Price
*Assistant Examiner*—Douglas B. Farrow
*Attorney, Agent, or Firm*—Donn J. Smith

[57] ABSTRACT

A quick-open blister package comprises a base member and a blistered containment member peripherally secured to the base member. The base member is frangible substantially along a plane contained therewithin, and first and second series of score lines extending at least in part about the periphery of the blister are cut into the base member substantially to the depth of the plane of frangibility. The blister is secured to the base member within that area thereof which is defined by the series of score lines. A considerable area of the base member can extend laterally of the blister for front printing.

36 Claims, 32 Drawing Figures

Fig. 6B.
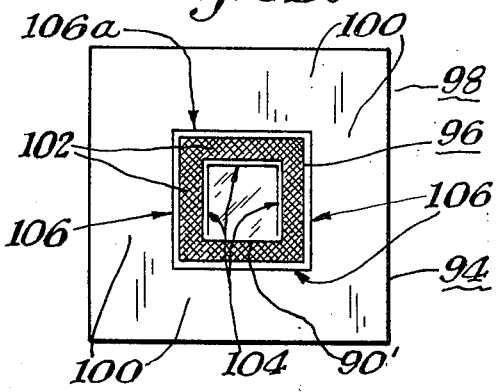
Fig. 6C.
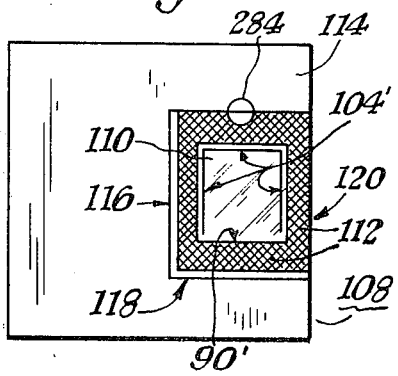
Fig. 6D.
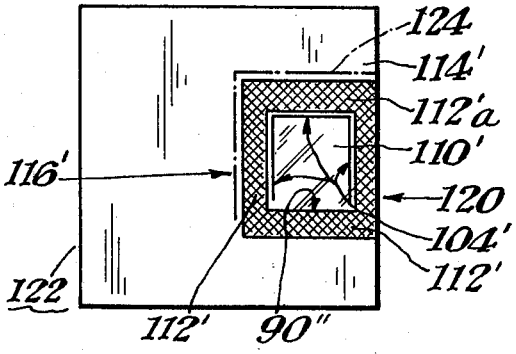
Fig. 7.
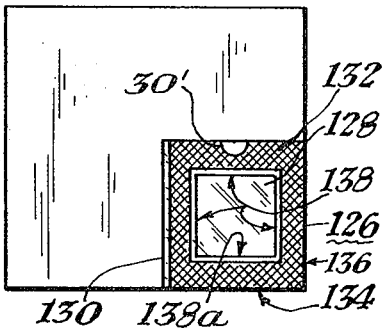
Fig. 6E.
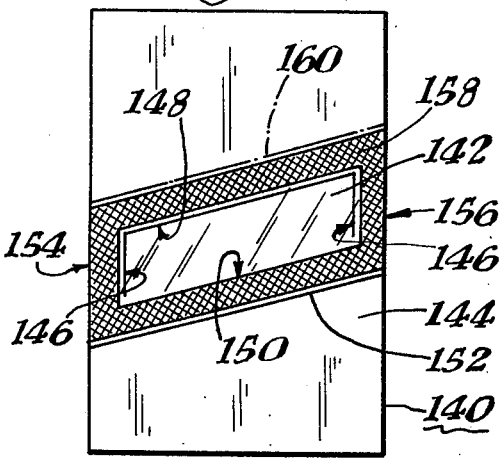
Fig. 8.
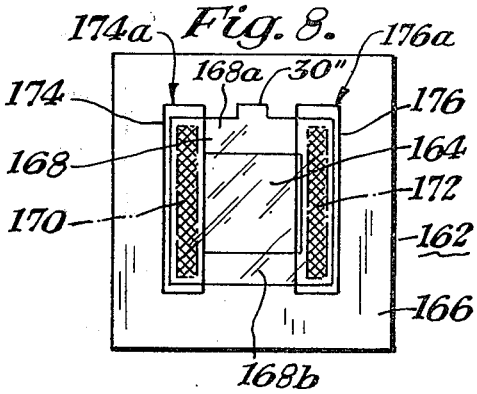
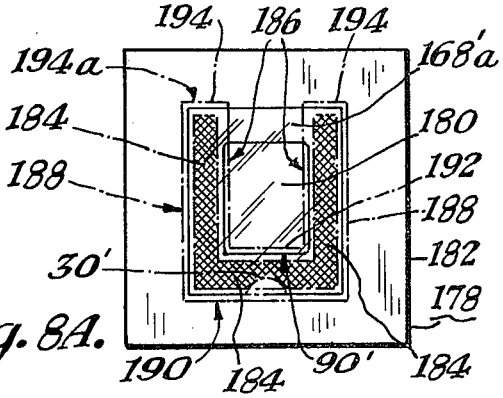
Fig. 8A.

Fig. 9.
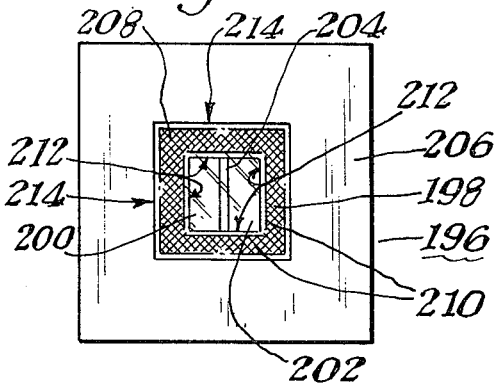
Fig. 9A.
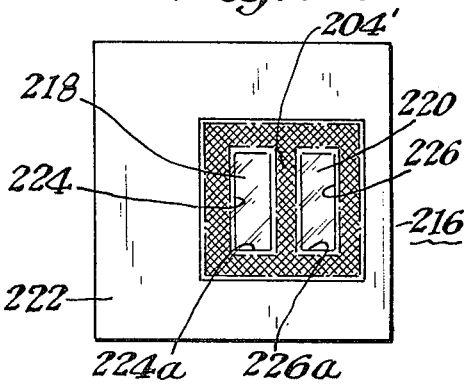
Fig. 10.
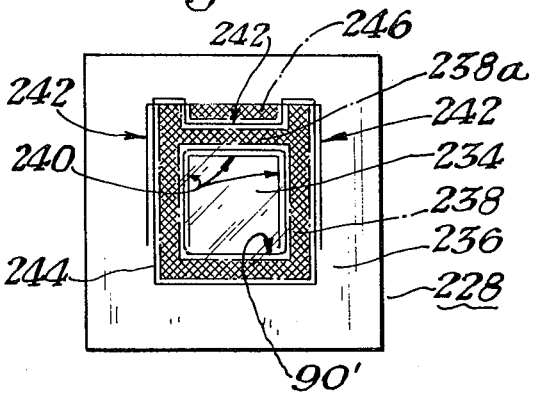
Fig. 10A.
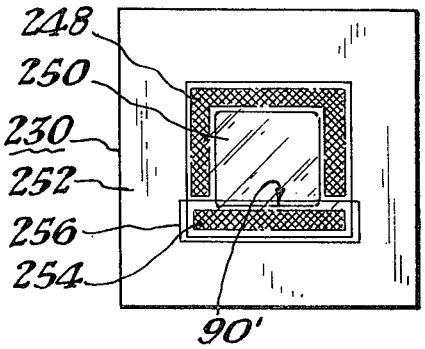
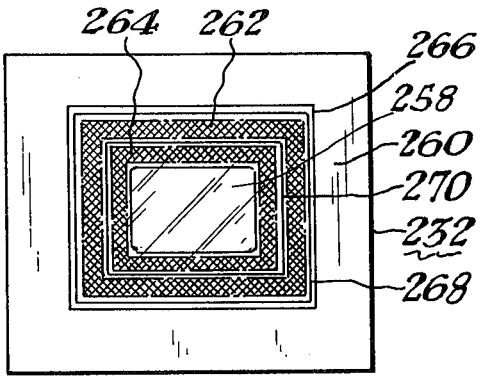
Fig. 10B.
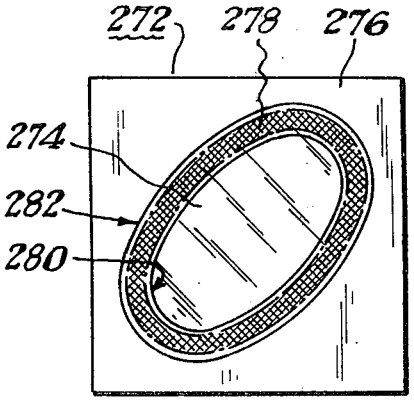
Fig. 11.

TEAR-AWAY BLISTER PACKAGE

The present application is a continuation-in-part of my copending application filed July 7, 1972 for TEAR AWAY BLISTER PACKAGE, Ser. No. 269,752, now abandoned.

My present invention is in certain aspects an improvement upon the blister packages and claimed in my previous applications Ser. No. 812,234, QUICK-OPEN CONTAINER STRUCTURE filed Apr. 1, 1969, now U.S. Pat. No. 3,595,446; Ser. No. 43,717, QUICK-OPEN FLEXIBLE PACKAGE filed June 5, 1960 now U.S. Pat. No. 3,635,376; Ser. No. 716,554 for INDIVIDUALIZED DISPENSING PACKAGES, filed Mar. 27, 1968 now U.S. Pat. No. 3,540,570; Ser. No. 725,610 for QUICK-OPENING PACKAGE filed May 1, 1968 now U.S. Pat. No. 3,472,367; Ser. No. 765,097 for QUICK-OPENING BLISTER PACKETS filed Oct. 4, 1968 now U.S. Pat. No. 3,472,368; and Ser. No. 21,628, QUICK OPENING FULCRUM PACKAGE filed Mar. 23, 1970, now U.S. Pat No. 3,689,458.

The present invention relates to blister packages, and more particularly to a package of the character described incorporating an arrangement for quickly and easily opening a blister type package without damage to the contained item or items and without controlled tearing of the blister or the customary backing card.

Packing of a wide variety of products in blister type packages has become quite common. The usual types of blister packaging involves a transparent plastic-bubble sealed or otherwise secured to a cardboard backing. Usually the backing member is extended laterally of the transparent blister to allow space for printing or illustration such as advertising or other descriptive materials, or directions for use or assembly.

Heretofore considerable difficulty has been experienced in opening blister type packages. Both the plastic employed for the blister and the cardboard of the backing member are sufficiently heavy that they are not readily torn. Moreover, an attempt to tear or cut either the blister or the carboard backing can damage the contained item or items while attempts to manually lift the blister flange from the backing member can cause a painful cut under the fingernail of the user. In addition, tearing the blister from the cardboard backing, beyond the physical difficulties in doing so, leaves unsightly tear portions of the cardboard backing adhereing to the blister edges.

I am aware of a number of attempts in the past to produce quick-opening blister packages. While these attempts are justifiably suited to their intended purposes, they do not completely solve the problems to which my invention is directed as noted below. Rasmussen et al U.S. Pat. No. 3,035,691 discloses a blister package having a three-sided, single set of score lines and a fold line along a fourth side intermediate the ends of the blister. The backing member therefore is not completely removed from the total blister opening.

Capezzuto U.S. Pat. No. 3,127,010 removes portions of the adjacent layer of backing material by means of scored circlets. Small circles of the backing material are removed and remain adhered to the blister flange when the latter is pulled away from the backing member. However, the blister and backing member not only cannot be sealed to one another, but the complete removal of the backing member is not intended. A fold line must in addition be embossed into the backing member. Grossman U.S. Pat. No. 3,255,880 utilizes a scored cut-out area in the backing member to gain access to the blister flanges. Additional steps in the opening sequence are thus produced, along with difficulties in directing the user's attention to the location of the score lines and proper severance of the backing member portion thereat, particularly in packages with which the user is unfamiliar.

Bostrom U.S. Pat. No. 3,288,280, Edwards U.S. Pat. No. 3,325,000 and Burnside U.S. Pat. No. 3,630,346 disclose blister packages having a fingertab or the like for grasping and peeling the blister away from the backing member or vice versa. The last-mentioned group of packages appear to depend on the use of frangible cementing or heat sealing for their quick opening function, which are not altogether reliable and frequently require the application of considerable opening forces and inadvertent damage to the contained items.

The Bostrom and Rasmussen packages require the blister and backing materials to be coextending in planar areas. No free card areas laterally of the blister flanges remain for printing of advertising or instructional material or other indicia. Only the reverse side of the backing material can be so used, which may escape the notice of the purchaser or which may be too small in area in any event. The same is applicable to other known packaging such as the peel-back unit-dose and peel-back condiment packages. In contrast, my quick-open blister package can provide extensive card areas laterally of the blister. That is to say the blister proper and its securance flanges are substantially smaller than the card or backing member so that both printed indicia and the contained item can be displayed on the front of the card.

Potter U.S. Pat. No. 3,215,267 shows a cellophane-wrapped packet frangibly sealed to the base member such that removal of the package exposes opening cuts in the cellophane wrapping. Neary U.S. Pat. No. 2,884,127 discloses a perforated blister removed by twisting; however, the package is not sealable. Wayne U.S. Pat. No. 3,069,273, Baermann U.S. Pat. No. 3,301,394 and Hey et al U.S. Pat No. 3,192,091 show frangibly sealed, peelable closure sheets adhered to "blister" flanges. Kuster U.S. Pat. No. 3,498,448 sets forth a package utilizing a pull strip on the base member which is otherwise not severable from the blister. Werepny, Jr. U.S. Pat. No. 2,874,836 requires the base member of the package to be cut entirely through. Lingley U.S. Pat. No. 3,075,639 shows rupture of the blister itself, while British Pat. No. 932,694 relates to a blister package wherein the blister section is made in two discrete parts. Jarecki U.S. Pat. No. 3,314,535 requires specialized package and base structure at the junction of the package and the backing card. Tjaden U.S. Pat. No. 3,397,774 employs a hinged base portion adjacent the back of the blister for opening the package. These patents likewise fail to disclose the features of my invention.

In my novel quick-opening blister package, the opening sequence is immediately apparent to the user without printed instructions. The means for affording the quick-opening function can be imparted to the package simultaneously with normal manufacturing operations such that making of the package is not further complicated. Moreover, specialized sealing techniques or the use of frangible cements is not required. Similarly an especially constructed backing member is not necessarily employed. Instead, conventional blister and backing member materials e.g. the commonly used plastic-coated or white layered cardboard can be employed for my novel package. Likewise, a uniform, grey cardboard is usable, if a white printable surface is not essential. Most importantly, my package can be completely and reliably sealed against entry of dust particles or other contamination. A simplified opening sequence is provided by my invention, while permitting use of lateral card areas for frontprinting of advertising, instructions, and other indicia.

I overcome the disadvantages of the prior art and achieve the foregoing desirable results by providing a quick-open blister package comprising a base member, a blistered containment member peripherally secured to said base member, said base member being frangible substantially along a plane contained therewithin, a first series of score lines in said base member and extending peripherally about said blistered member closely adjacent an opening thereof, a second series of score lines spaced outwardly of said first series and extending at least partially about the blistered member periphery, said first and said second score lines being cut into said base member substantially to the depth of said plane of frangibility, said blistered member being secured to said base member only within that area thereof which is defined by said series of score lines, whereby a substantial area of said base member can be extended laterally of said blistered member for front printing and the like.

I also desirably provide a similar quick-open blister package wherein said blistered member is provided with a peripheral securance flange, and a raised fingertab is molded integrally on a portion of said flange.

I also desirably provide a similar quick-open blister package wherein a finger lift is formed integrally with an end portion of a pocket area of said blistered member.

I also desirably provide a similar quick-open blister package wherein said base member is a laminated structure having a layer which is relatively more frangible than the remainder of said base member, said frangible layer substantially defining said plane of frangibility.

I also desirably provide a quick-open blister package comprising a base member having a frangible layer therewithin, a containment blister peripherally secured to said base member, first and second score lines cut in said base member substantially to the depth of said frangible layer, said series of score lines being spaced from one another and each partially surrounding said blister, said blister having a peripheral securance flange with portions thereof juxtaposed to an area of said base member enclosed between said series of score lines, said juxtaposed flange portions being secured only to said enclosed area, said flange having a remaining portion secured to said base member outside of said enclosed area to form a "living" hinge upon opening of said package.

I also desirably provide a similar quick-open blister package wherein opening means are coupled to one of said juxtaposed flange portions at a location remote from said remaining flange portions.

During the foregoing discussion, various objects, features and advantages of the invention have been set forth. These and other objects, features and advantages of the invention together with structural details thereof will be elaborated upon during the forth coming description of certain presently preferred embodiments of the invention and presently preferred methods of practicing the same.

In the accompanying drawings I have shown certain presently preferred embodiments of the invention and have illustrated certain presently preferred methods of practicing the same, wherein:

FIG. 6B is a top plan view of still another form of my novel tear away package incorporating the living hinge feature of the FIG. 6 modification and also an optional, complete-removal feature;

FIG. 6C is a similar view of another form of my package incorporating both a theft-resistant feature and the living-hinge feature described previously;

FIG. 6D is a top plan view of a modified form of the package shown in FIG. 6C and incorporating in addition a "tear away" or complete removal feature;

FIG. 6E is a top plan view of another form of the package shown in FIG. 6D;

FIG. 7 is a top plan view of another novel package of my invention, incorporating a theft-resistant feature;

FIGS. 8 and 8A are top plan views of still other forms of my novel package constructions representing interrupted sealing arrangements in combination with the unique "tear away" feature of the invention;

FIG. 9 is a top plan view of still another form of my novel package;

FIG. 9A is a similar view of a modified form of the package of FIG. 9;

FIG. 10 is a top plan view of still another modification of the invention;

FIG. 10A is a similar view of a modification of the package shown in FIG. 10, and FIG. 10B is a similar view of still another form of the package shown in FIG. 10.

FIG. 11 is a top plan view of still another modification of the tear-away package of the invention.

Figure 1:
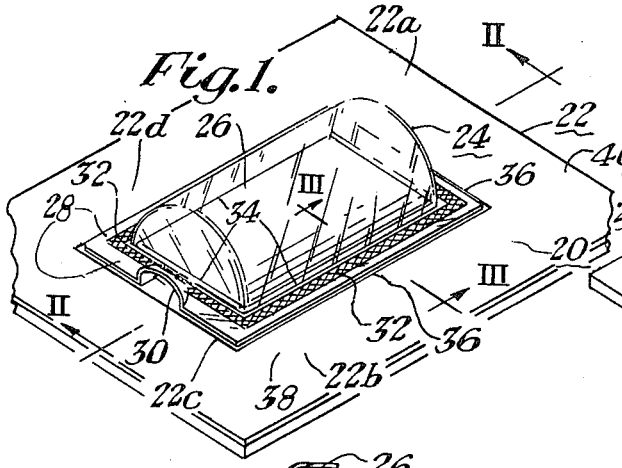
FIG. 1 is an isometric view of one arrangement of my novel quick-open blister package, in accordance with the invention.
Figure 1A:
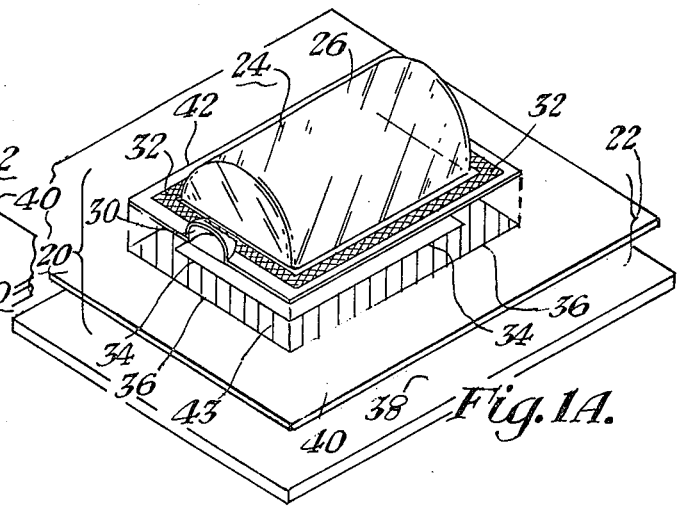
FIG. 1A is an isometric exploded view of the package shown in FIG. 1 but having the blister removed from the card or backing member.
Figure 2:
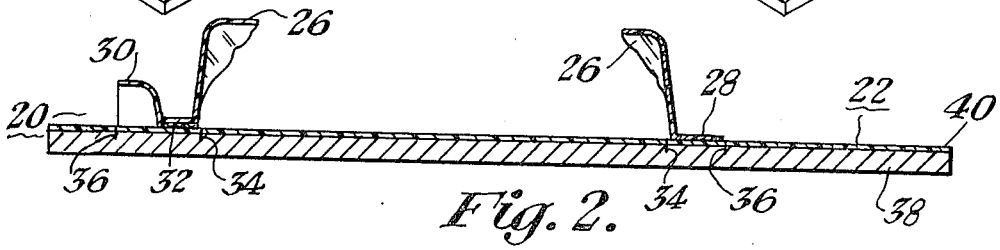
FIG. 2 is a cross-sectional view of the package as shown in FIG. 1 and taken along reference line II-II thereof.

Referring now to FIGS. 1, 1A and 2 of the drawings, the exemplary package 20 shown therein includes a card or backing member 22 and a formed blister component 24. Typically the blistered containment member 24 includes a pocket portion 26 and a peripheral securance flange 28 joined thereto. The containment blister 24 can assume a variety of shapes and sizes depending upon the configuration of the item or items (not shown) contained therein. To facilitate initiation of the opening procedure the blister 24 desirably is provided with a fingertab or "lift" 30. As better shown in FIG. 2 the finger lift 30 can be molded upwardly from a portion of the blister flange 2B. The fingertab 30 thus can be molded as a "half blister," as it were, simultaneously with the molding or shaping of the remaining portions of the blister 24. The tab or lift 30 desirably is configured such that the user of the package 20 can insert an end of one of his fingers for initiating the opening procedure described below.

The blister flanges 28 can be either heat-sealed or adhered with an ordinary adhesive or cement to the card or backing member 22 as denoted by the shaded areas 32 of FIG. 1. However, in accordance with the invention, the securance or sealing area 32 is first delimited by first and second, spaced series of score lines 34, 36 respectively. Desirably, the score lines 34, 36 are disposed slightly inwardly and slightly outwardly, respectively, of the securance card area or band 32 to ensure that the adhered area does not extend inwardly of the inner series of score lines 34 or outwardly of the outward series of score lines 36. This ensures complete and facile removal (FIG. 1A) of the blister 24 from the backing member 22 without adherence of ragged edges of the backing member, as explained more fully below. Note that the backing member or card 22 can be extended laterally on all sides of the blister 24 (as denoted by reference characters 22*a*, 22*b*, 22*c*, 22*d*) for adequate space for printing of advertising, instructions and other indicia visible from the front of the package.

Figure 1B:
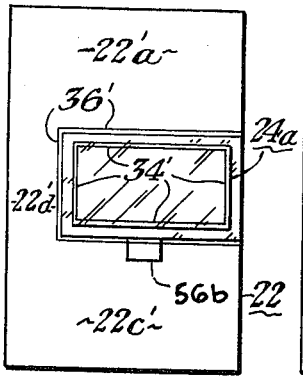
FIGS. 1B, 1C, 1D, 1E and 1F are top plan views showing differing locations of the blister on a backing member therefor.
Figure 1C:
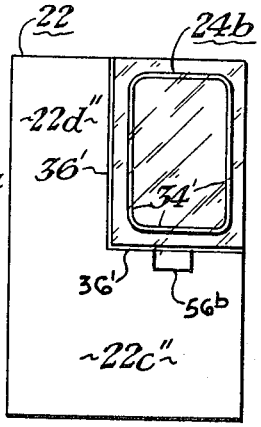

As better shown in FIGS. 1B and 1C the blister 24*a* or 24*b* need not be centrally located on the card 22. In FIG. 1B the blister 24*a* is located adjacent one edge of the card 22 leaving lateral card areas 22*a*′, 22*c*′, 22*d*′ for printed indicia. In FIG. 1C the blister 24*b* is located in a corner area of the card 22 leaving card areas 22*c*″ and 22*d*″ for printing. Naturally, other blister positions than those represented in FIGS. 1, 1B, 1C are within the context of my invention. Inner scorelines 34′ are provided as in FIG. 1. Outer scorelines 36′ are extended along those portions of the blister periphery which are removed from the card edge or edges.

Figure 1D:
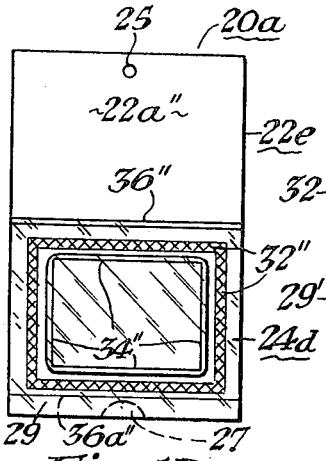
Figure 1E:
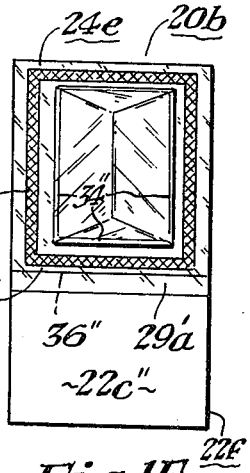

For example in FIGS. 1D and 1E the blister 24*d* or 24*e* is located at one end of blister display card 22*e* or 22*f* to form blister/card package 20*a* or 20*b*. The blister flanges in these latter examples can coincide with three adjacent edges of the card 22*e* or 22*f*. A fourth card edge is remote from the blister 24*d* or 24*e* to provide an adequate front printing area 22*a*″ or 22*c*″. The blister/card package 20*a* of FIG. 1D can be provided with hole 25 for display from a suitable hook or the like. Each package 20*a*, 20*b* is provided with inner score lines 34″ as before, but can be provided with a single outer scoreline 36″. Alternatively, an additional scoreline 36″*a* can be placed between the base member notch 27 and the sealed area 32″ in package 20*a* (FIG. 1D) after the manner of FIGS. 1F and 1G. In FIG. 1D the card 22*e* is notched at 27 so that widened flange area 29 can be grasped for opening. In FIG. 1E a portion 29′a of the widened flange 29′ is left unsealed for the same purpose. Grasping of the flange portion 29′*a* can be facilitated by shaping as shown. Alternatively as shown in FIG. 1G the unsealed flange area 29″*a* can be provided with fingertab 30′ or equivalent opening facilitating means, such that the adjacent scorelines 36″*a* lies between the tab 30′ or the like and the flange sealing area 32′. The arrangement facilitates grasping and raising the unsealed flange portion 29″*a*. In any event printing or other indicia can be provided on the card under the unsealed flange portion 29′*a*, or other unsealed lifting tab, which can be extended to an adjacent card edge, if desired.

The various scorelines 34, 36 can be placed somewhat closer to the associated sealed areas such as area 32, or farther therefrom, depending upon the required opening forces. Likewise, the width of the securance or sealed area can be varied, together with the corresponding width of the card frame or portions to be removed from the card 22 as defined by the area between the scorelines 34, 36. Although shown as desirably continuous, the scorelines 34, 36 can be only substantially continuous, i.e., a series of interrupted lines or "dashes" or partial perforations sufficiently closely spaced to prevent ragged tearing when the blister is removed.

Figure 1F:
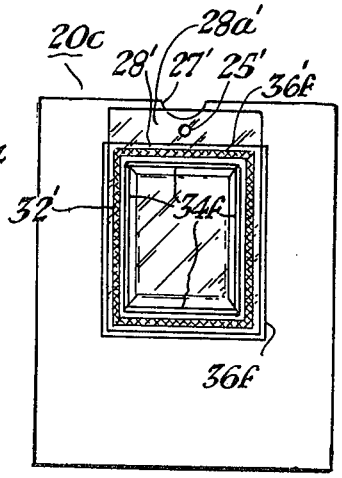
Figure 1G:
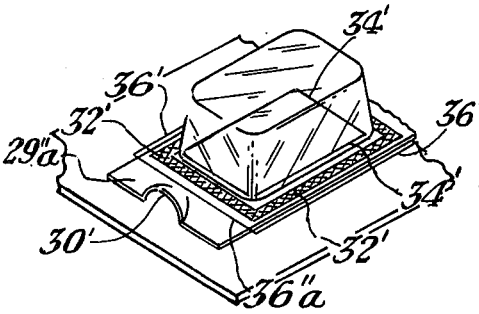
FIG. 1G is a partial isometric view of another embodiment of the invention

Theft of the contents of my blistered type packages can be minimized in an unexpected manner by the modification of my package 20*c* as shown in FIG. 1F. The package 20*c* is generally inverted with respect to the package 20*a* of FIG. 1D, and the display hole 25′ is extended through that portion of the blister flange 28′ adjacent the base member opening notch 27′ (when provided). Thus, when a group of the packages 20*c* are suspended from a hook or peg (not shown) it is virtually impossible to open the package 20*c* and to remove the contents thereof without removing the package from the hook or peg. In the package 20*c* of FIG. 1F it will be appreciated that the notch 27′ can be omitted and other opening means such as the raised fingertab 30 of FIG. 1 can be substituted. In the latter event, the flange portion containing the suspending aperture 25′ can be widened in order to accommodate both the fingertab (not shown in FIG. 1F) and the hole 25′, or the aperture 25′ can be extended through the base or card and the fingertab, which, when provided, forms part of the blister flange portion. It is also contemplated that the outer portion 28′*a* of the flange portion can be left unsealed to facilitate opening. In the latter event a scoreline 36′*f* should separate the sealed and unsealed areas of the flange 28′.

Figure 3:
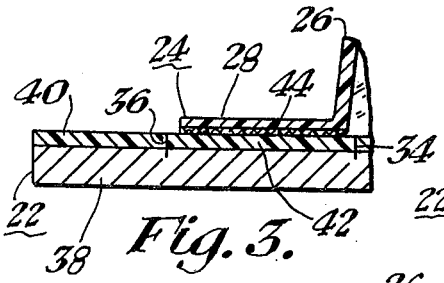
FIG. 3 is an enlarged partial sectional view of the package as shown in FIG. 1 and taken along reference line III-III thereof.

The composition of the card or backing member 22, in the modification of the invention as illustrated in FIGS. 1–3, is that which is commonly used for blister type packages. Thus, the card 22 can be made from a typical gray cardboard material as denoted by its principal or main layer 38, on which there can be a superficial layer 40 of light cardboard material to provide a proper surface for printing or labeling. The blister flanges 28 can then be joined to the superficial cardboard layer 40 by a non-frangible cement. Alternatively the layer 40 can be a commonly used white plastic coating or laminated plastic and white cardboard layer such that the blister flanges 28 can be non-frangibly heat-sealed thereto. Alternatively again the superficial layer or layers 40 can be omitted, as these layers are not necessary for establishing a plane of frangibility through the base layer 38, as noted below. In any event the base layer 38 of the backing member 22, in this example, is more frangible than the superficial layer or layers 40 (if used), for reasons set forth below.

In any event a base member is desirably selected which has a layer of material which is internally frangible substantially longitudinally along a number of closely parallel planes within the base member, with the result that the score lines can penetrate to a given one of such planes. With this arrangement, the depth of penetration is not critical, as long as the score lines penetrate to one of the planes of frangibility. In other words the frangible layer has an appreciable thickness such that the precise depth of the score lines is not critical. In fact the depth of the score lines will determine that plane of frangibility within the backing or base member 22, along which tearing will occur during the subsequent opening procedure.

As better shown in FIGS. 2 and 3 of the drawings each of the series of scorelines 34, 36 penetrated through the superficial layer or layers 40 of the backing member 22 and into the base layer 38 thereof, which is usually more frangible than the superficial layer 40 (if used). Such penetration exists on each side of the secured area or band 32.

In any event the bottoms of the scorelines 34, 36 establish substantially the lowest plane of frangibility within the base member 22. Thus, when the blister 24 is removed in its entirety from the card or backing member 22 (FIG. 1A) a portion of the base member 22 including that portion of the superficial layer 40 (if used) extending between the scorelines 34, 36 as designated by area 42 (FIG. 3), is removed from the card possibly along with an adjacent portion of the base layer 38, depending on the precise depth of the scorelines and the specific opening sequence applied to the package. The thickness (transverse to the card 22) of the removed area or frame or band 42 will depend to a large extent on the penetration of the scorelines 34, 36, the frangibility of the base member layer 38, and the strength and penetration of the cement or other means for joining the superficial layer 40 to the base layer 38 of the backing member. Area 43 (FIG. 1A) from which the frame 42 is removed by tearing away the blistered member 24 is thus cleanly defined.

It is contemplated that my novel package can be made more or less difficult to open, e.g. for child-proofing, discouraging tampering, or for semi-invalids. Lesser opening forces can result from a softer, more frangible cardboard material, of which many grades are available. Similarly, a harder cardboard engenders greater opening forces, which can be further amplified through a mixture of particulate or shredded polyethylene or other admixture of suitable filler with the cardboard material. Naturally, the cardboard or other backing member cannot be made less frangible than the securance between the blister and the adjacent surface of the backing member — in keeping with the teachings of my present invention.

It is important to note in any event that the actual securance means or seal 44 between the blister flanges 28 and the removed frame portion 42 remains intact. Thus, it is not necessary to use a frangible junction between the blister flanges 28 and the card 22 or to employ interrupted or spaced, cemented or heat-sealed areas. Accordingly, a sealed integrity of the package 20 can be preserved until the moment of opening, while still allowing the quick-opening feature of the invention. Use of the score lines 34, 36 (which can be applied to the card or backing member 22 at the same time that the latter is printed) permits a quick removal of the blister 24 and a well defined severed portion or frame from the card 22 without the unwanted inclusion of ragged edges or imperfect access to the blister pocket. The backing member of the package 20 can be extended considerably beyond the confines of the blister 24 as desired for inclusion of advertising material, instructions, or other printed information.

Figure 3B:
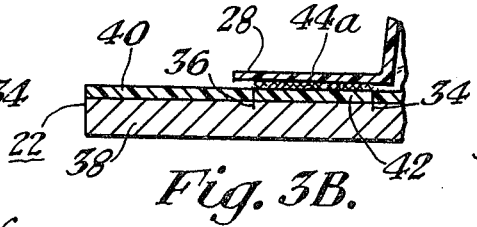
FIG. 3B is a similar view of still another modified form of the package.
Figure 3A:
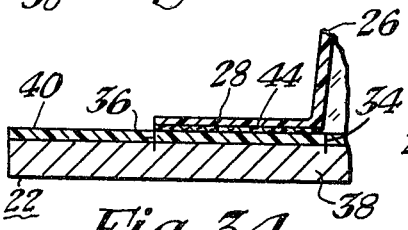
FIG. 3A is a similar view of a modified form of the package shown in a preceding figure.

As noted previously, the series of score lines 34, 36 can be separated by varying distances to exercise a degree of control over the opening forces of the package 20. For example, the score lines 34, 36 can be more widely separated to render the package more difficult to open in order to discourage removal of the packaged contents by small children who may be harmed thereby or by shoplifters. Possible variations in opening forces are evident from a consideration of FIGS. 3, 3A, 3B and 3C. In FIG. 3 the score lines 34, 36 are without the confines of the blister flange 28 respectively. A lesser opening force is required for the package of FIG. 3A where the score lines 34, 36 are substantially aligned with the inner and outer edges of the blister flange 28 (assuming the same width of blister flange). The package of FIG. 3A has an additional advantage in that the score lines 34, 36 are largely concealed by the edges of the blister flange 28. In FIG. 3B the score lines 34, 36 are moved inwardly of the blister flange edges for a further reduction of opening forces (again assuming the same flange width as in FIGS. 3, 3A). Because of the actual seal **44*a* between the blister flanges 28 and the card 22 is relatively non-frangible, the width of the seal 44*a* can be made substantially narrower than the severable card frame 42 to be removed i.e., the area bounded by score lines 34, 36,** and the aforementioned plane of frangibility.

Figure 3C:
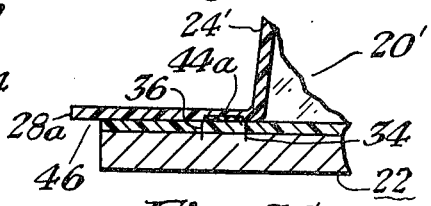
FIG. 3C is a similar view showing a modified form of the fingertab or "lift" of FIGS. 1 and 2.

In the blister package 20' of FIG. 3C the distance between the score lines 34, 36 is substantially reduced for a further and substantial reduction in opening forces. In addition, a portion **28*a* of the blister flange is extended to a point or line overhanging the card or backing member 22 as denoted by reference character 46 to provide a lifting tab for the blister 24'. In such case the finger lift shown in FIGS. 1 and 2** can be omitted.

Figures 4, 4A, 4B:
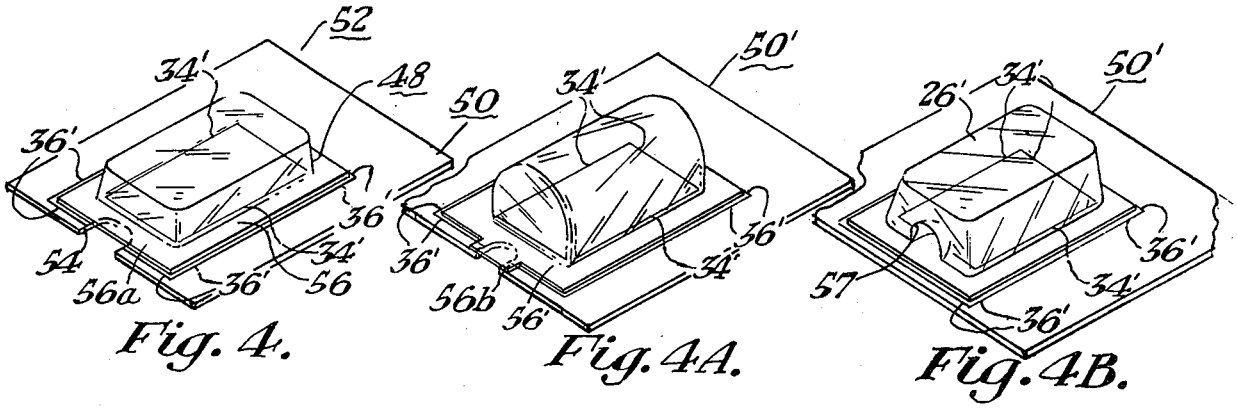
FIG. 4 is an isometric view of an alternative means for initiating opening of the package.
FIG. 4A is an isometric view similar to FIG. 4 but showing a modification of the opening means thereof.
FIG. 4B is an isometric view of still another form of opening initiation means.

Still another arrangement for initiating lifting of blister 48 from backing member 50 of blister package 52 is illustrated in FIG. 4. The backing member 50 is notched at 54 so that an edge of the card 50 lies beneath the adjacent portion of blister flange 56. Thus, it is not necessary to extend the blister flange portion 56 to the unbroken edge of the cardboard backing 50, in contrast to the arrangement of FIG. 3C. Portion **56*a* of the blister flange 56 can be widened as desired to lessen the depth of the notch 54. The widened portion 56*a* of the blister 48 can extend the full width of the blister as shown in FIG. 4 or alternatively as shown in FIG. 4A only a portion 56*b* of the adjacent blister flange side 56' need be so extended. When so extended the flange portion can be coterminous with the adjacent edge of the backing member 50 or 50' as denoted by the extended flange portion 56*b* of FIG. 4A or alternatively can terminate short of the backing member edge as denoted by the flange portion 56*a* of FIG. 4.**

As better shown in FIG. 4B the opening initiating means afforded by the invention can take other forms. The molded fingertab can be applied to the blister pocket portion 26' as denoted by reference numeral 57. The finger lift 57 can be molded to project inwardly a short distance into the blister pocket 26' as illustrated in FIG. 4B, or alternatively, where a sealed integrity of the package is not mandatory, the pocket 26' can be undercut or otherwise apertured (not shown) sufficient to admit an end of a person's finger or other object for the purpose of lifting one end of the blister to initiate opening of the package along scorelines 34', 36', as explained elsewhere herein.

Figure 5:
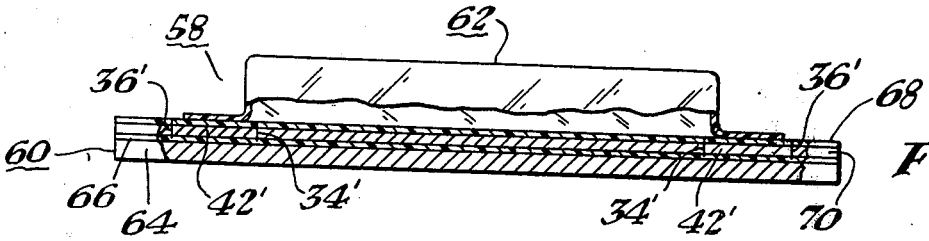
FIG. 5 is a cross-sectional view of another package made in accordance with my invention and showing the novel arrangement of backing member therefor.

Blister package 58 of FIG. 5 incorporates a modified form of backing member 60, which likewise can be used with any of the aforedescribed packages. A blister 62 is secured to the card or backing member 60 substantially as described previously. In this arrangement the card 60 is a laminated structure including a base layer 64 formed from commonly available cardboard material, which provides overall thickness and relative rigidity to the backing member 60. Layers 66 and 68 are formed from a plastic material such as polyethylene which resists tearing. Layers 66, 68 are bonded by layer 70 which, however, is relatively frangible, and the backing member separates through layer 70 when the blister 62 is severed therefrom carrying with it frame portion 42' as defined by score lines 34' and 36' in the manner described previously. In this case the score lines 34', 36' penetrate through the frangible layer 70 as evident from FIG. 5. Desirably, however, the score lines 34', 36' do not penetrate through layer 66 or into layer 64 of the backing member 60. Thus, upon opening of the package (as described above in connection with FIG. 1A and related Figures) the relatively thick cardboard layer 64 or like material provides stability for the opening sequence, while the frame or removed section 42' of the base member is severed therefrom between layers 66, 68, i.e., substantially along layer 70, which defines a plane of frangibility within the card 60.

Figure 6:
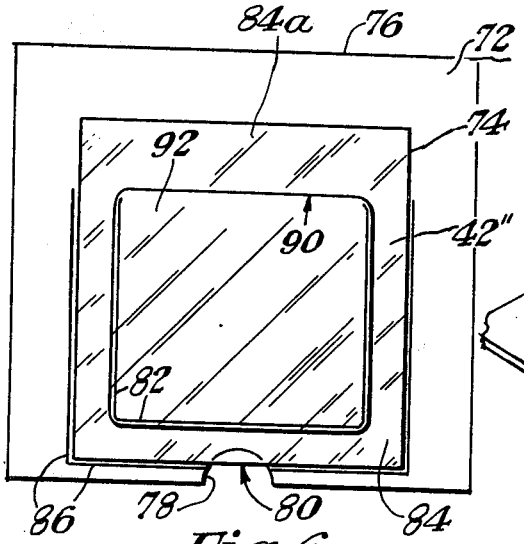
FIG. 6 is a top plan view of still another arrangement of my novel package.
Figure 6A:
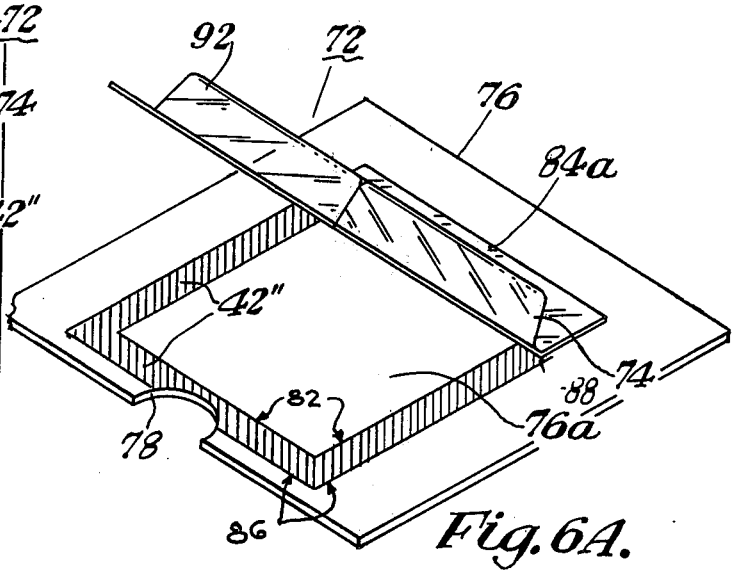
FIG. 6A is an isometric view of the package shown in FIG. 6 after opening.

With reference now to FIGS. 6, 6A of the drawings a modified opening sequence is exhibited by package 72 including blister 74 adhered to base member 76. The base member is notched at 78 to expose an edge 80 of the blister flange for opening purposes. Alternatively other opening initiating means can be substituted, e.g. those shown in FIGS. 1 and 2 or in FIG. 3C or in FIGS. 4, 4B. To facilitate removal of the blister 74 from the backing member 76, in accordance with the invention, a first and second, generally U-shaped series of score lines 82 and 86 are cut partially through the backing member 76 substantially in the manner described previously with respect to score lines 34, 36 or 34', 36'. The score lines 82, 86 are disposed adjacent the inside and outside edges respectively of the blister flange 84 and are extended about three sides of the blister or partially there around as shown in FIG. 6. The juxtaposed portions of the blister flange 84 are adhered to the area defined between the score lines 82, 86 as described previously. The remaining portion **84*a* of the blister flange is similarly adhered to the backing member or card 76 but outside of the tear away area 42'' of the card 76.**

During the opening sequence of the package 72, the blister 74 is not completely removed therefrom as better shown in FIG. 6A. Instead the blister 74 remains "hinged" to the card 76 by virtue of its flange portion **84*a*. The tear-away card portion 42'' likewise forms a hinge at its junctions 88 with the body of the card 76. The area 76*a* of the card 76 which is partially enclosed by the tear-away area 42'' naturally remains in place on the card 76 to expose the pocket of the blister 74 when the latter is partially torn away from the card but remains hinged thereto along line 90.**

The junction of the blister flange portion **84*a*, which remains adhered to the card 76 (FIG. 6A), with the remainder of the blister 74 along the line 90 forms a natural and "living" hinge as this represents the weakest area of the opened package 72. The areas on either side of the line or living hinge 90 are strengthened, on the one hand, by securance of the blister portion 84*a* to the card 76, and on the other hand by the arch effect of blister pocket 92. The quick-open blister package 72 has the advantage of reclosure where desired and even resealing, by adhering lengths of Scotch brand tape or the like along the torn away blister flange portions, i.e., those flange portions other than the hinged flange portion 84*a*, to reseal the torn away blister flange portions to the card 76.**

In FIG. 6B of the drawings another form of my novel package 94 is disclosed. In the package 94 a flanged blister member 96 is adhered to a generally central location of the card 98. The peripheral areas 100 of the card 98 can be employed for the application of instructional or advertising indicia or the like. Alternatively the blister 96 can be located at an edge of the card 98 after the manner of FIG. 6C or in a corner thereof after the manner of FIG. 7. Flanges 102 of the blister 96 can be adhered to the card 98 by heat sealing as set forth previously.

Desirably the card 98 is provided with a series of three inner score lines 104 as in FIG. 6 to provide a living hinge 90', and in this case the blister 96 is opened downwardly (as viewed in FIG. 6B). The card 98 is also provided with outer score lines **106, 106*a* which surround the blister 96 and its flanges 102. In contrast to FIG. 6 the outer score lines 106, 106*a* extend entirely around the blister 96 so that the blister can be hinged after the manner of FIG. 6 for reclosure if desired, or so that the blister 96 can be completely removed from the card 98 without defacing any indicia applied to the peripheral portions of the card 98, after the manner of FIG. 1** and related figures.

Alternatively the fourth outer score line **106*a* can be omitted in order to enhance a theft-resistant characteristic of the package 94. Omission of the line 106*a* considerably increases the difficulty of initiating the tear-away opening of the blister 96,** which is opened downwardly as aforesaid.

Although the inner score lines 104 are shown inwardly of the flanges 102 and the outer score lines **106, 106*a* are shown outwardly thereof, it will be understood that these score lines can coincide respectively with the inward and outward edges of the blister flanges 102, as noted previously. Further, these score lines can be placed respectively within the confines of the flanges 102,** depending upon the width of the heat sealed area thereof.

A similar arrangement is employed in package 108 of FIG. 6C, save that blister 110 and its sealing flanges 112 are located at an edge of card 114. Thus, the living hinge 90' of FIG. 6C is delineated by the three inner score lines 104', while the outer score lines 116, 118 together with adjacent edge 120 of the card 114 (which in effect forms the third outer score line) provide the further, tear-away feature of the package 108, whereby the blister 110 can be completely removed when the living hinge feature thereof is no longer needed.

The absence of a fourth score line at the top of the blister 110 (as viewed in FIG. 6C) provides the theft resistant feature mentioned previously and alternatively in connection with the package 94 of FIG. 6B.

In my novel package 122 of FIG. 6D similar reference numerals with primed accents denote similar components of the package 108 of FIG. 6C. In the package 122 an outer score line corresponding to line 118 of FIG. 6C is omitted so that the package 122 does not have complete tear away capability after the blister 110' is opened on its living hinge 90''.

As in the package 108 of FIG. 6C the package 122 can be provided with theft resistance by omission of an outer score line along the top edge (as viewed in FIG. 6D) of the blister flange 112'*a*. Of course, if such theft resistance is not desired an outer score line, as denoted by chain line 124 can be added along the top of the blister 110'.

My novel package 140 of FIG. 6E is functionally similar to the package 108 of FIG. 6C, save that blister 142 of the package 140 extends between opposite sides of card 144. In the illustrated modification the blister 142 is thereby configured for containment of one or more elongated items (not shown).

Inner score lines 146, 148 provide a living hinge capability as denoted by reference numeral 150, while a single outer score line 152 provides for complete removal capability of the blister 142. The remaining outer "score lines" are provided in effect by adjacent and opposing edge portions 154, 156 of the card 144.

An outer score line adjacent the top edge (as viewed in FIG. 6E) of blister flange 158 desirably is omitted for theft-resistant capability, similar to that described in connection with FIGS. 6B-6D. Alternatively, if such theft-resistance is not desired, a top score line can be provided as denoted by chain outline 160 thereof, to facilitate opening of the blister 142.

For advertising purposes, or for eye-catching appeal in general, the elongated blister 142 can be disposed at an angle to the long or short axis of the card 144. Obviously, the blister 142 can be disposed rectilinearly (not shown) on the card 144, if preferred.

In FIG. 7 package 126 is illustrated which is generally similar to the FIG. 1C embodiment of the invention with respect to the blister-card spatial relationship. In the case of the package 126, however, blister 128 is opened downwardly (as viewed in FIG. 7) and opening tab 30' is provided. Only a single outer score line 130 is employed. The remaining outer score lines are provided in effect by adjacent card edges 134, 136. With the omission of any score line along the top edge of blister flange 132 the package 126 is provided with a theft-resistant feature similar to that discussed primarily with references to FIGS. 6B and 6C. Four inner score lines 138, 138*a* are provided in the package 126. However, if the living hinge feature of the preceeding FIGS. 6-6E is desired, one of the four inner score lines, for example the bottom score line 138*a*, can be omitted.

In the package construction 162 of FIG. 8 blister 164 is adhered to card 166 by discontinuous sealing techniques. As in previous modifications, the blister 164 is provided with a peripheral sealing flange 168 which is adhered to the card 166 by means of discrete and spaced sealing areas 170, 172. The unsealed areas 168*a* and 168*b* of the peripheral flange lay flush against the card 166, owing to the relative stiffness of the material from which the blister 164 is made. In consequence the contents of the package 162 are protected fairly well against entry of dust or other foreign material.

The tear-away feature of the invention is provided by series of score lines 174, 176 which surround respectively the displaced sealing areas 170, 172.

The unsealed flange areas 168*a*, 168*b* can be employed to initiate the tear-away procedure, by suitably bending the card 166 so that one of the unsealed flange areas 168*a* or 168*b* can be grasped. The blister 164 can be opened either downwardly or upwardly, as the package 162 is symmetrical. Alternatively and desirably, the package 162 can be provided with an opening, finger tab 30'', after the manner of FIG. 1F or other relevant Figures. If theft resistance is desired and, for example, the blister 164 is opened downwardly, upper horizontal components 174*a* and 176*a* of the series of score lines 174, 176 can be removed.

A similar package 178 is illustrated in FIG. 8A. Blister 180 in this example can be arranged for removal either upwardly or downwardly (as viewed in FIG. 8A) of card 182 and is provided with a three-sided peripheral seal 184. The card 182 is provided with a pair of inner score lines 186 and outer score lines 188, 190. Flange portion 168*a'* of the blister 180 remains unsealed in this example and can be employed to initiate opening of the package 178, if desired. Score lines extending across the upper ends of the heat sealed area 184 desirably can be omitted for theft-resistant capability. By omission of an inner score line at the bight portion of the U-shaped sealing area 184 a living hinge 90' can be provided, as described in certain of the preceeding Figures. If it is not desired to completely remove the blister 180 from the card 182 the horizontal outer score line 190 can be omitted.

Alternatively, if it is desired to open the package 178 by completely removing the blister 180 in the upward direction additional inner and outer score lines denoted respectively by chain outlines 192, 194 thereof can be added. An opening tab 30' if used, could be located at the bottom in that case.

A compartmented package 196 is shown in FIG. 9 wherein blister 198 is provided with two blister compartments 200, 202. It will be understood that a larger number of blister compartments can be provided, if desired. The space or partition 204 between the compartments 200, 202 is formed in the plastic material comprising the blister 198 and desirably lies directly flushly upon the adjacent surface of an underlying card 206.

In this example the partition 204 is not heat-sealed to the card 206, with heat-sealing 208 being confined to a peripheral flange 210 of the blister 198. Inner and outer series of score lines 212, 214 are provided in the card 206 to afford the tear-away capability of the invention, after the manner of FIG. 1 and related Figures. If desired one side of the inner score lines 212 can be omitted to provide the living hinge feature of the invention as shown in FIG. 6 and related figures. Simlarly, one or more sides of the outer series of score lines 214 can be omitted if the living hinge of FIGS. 6 or 7 only is desired, or if the blister 198 extends to one or more edges of the card 206, or if the theft-resistant feature of the invention is utilized.

A similar package 216 is illustrated in FIG. 9A in which blister compartments 218, 220 are separated by a formed partition 204'. In this case the partition 204' is heat sealed directly to the card 222, and each compartment 218 or 220 is provided with its own independent series of inner score lines 224 or 226 respectively. Adjacent horizontal portions 224*a*, 226*a* of the inner series of score lines 224, 226 can be omitted if the living hinge feature of the invention is desired.

Various forms of reclosable packages 228, 230, 232 are illustrated in FIGS. 10, 10A and 10B respectively. In FIG. 10, blister 234 of the package 228 is adhered to the card 236 by a peripheral heat seal 238 after the manner of the preceeding Figures. As in previous embodiments, a living hinge 90′ can be afforded by omitting the adjacent inner score line and by inner and outer score lines 240, 242 extending about three sides of the blister 234 and its sealing flange 244. In the example of FIG. 10, a reclosable feature is afforded by a strip of pressure sensitive adhesive 246, which is adhered to the card 236 and extends along an upper flange portion of the blister 234 and opposite the living hinge 90′. The pressure sensitive adhesive strip 246 extends parallel with and outside of a reduced-width portion 238*a* of the peripheral heat seal 238. Accordingly the blister 234 virtually is hermetically sealed by the heat seal 238. It will also be observed from FIG. 10 that the pressure sensitive strip 246 lies outside of the adjacent portions of the outer score lines 242. Accordingly the surface of the card 236 underlying the reclosable sealing strip 246 is not removed, in contrast to the surface underlying the peripheral heat seal 238, when the package 228 is opened.

The reclosable feature of the package 230 of FIG. 10A is provided by pressure sensitive adhesive 248 extending about three sides of the blister 250. The fourth side of the blister 250 is adhered to card 252 by means of heat seal 254. Surrounding the heat sealed area 254 is a peripheral score line 256 cut into the card 252 after the manner of the previously described score lines. As in FIG. 10 the use of the pressure sensitive sealing area 248 in FIG. 10A affords reclosability, while the heat sealed area 254 and the surrounding score lines 256 define a living hinge 90′ and provide a tear-away feature respectively.

The reclosable package 232 of FIG. 10B, blister 258 is adhered to card 260 by an outer peripheral (non-frangible) heat seal 262 and an inner peripheral pressure sensitive (frangible) seal 264. Conventional pressure sensitive adhesives can be employed for the pressure sensitive sealing areas of FIGS. 10, 10A, 10B.

Outer score lines 266 are extended about the periphery of the blister flange 268 as in certain of the preceeding Figures. Inner score lines 270 however are extended about the inner periphery of the heat seal 262 and thus lie between the heat seal 262 and the pressure seal 264. When the blister 258 is removed from the card 260 a "frame" lying between the score lines 266, 270 is removed from the surface of the card 260, as described previously. However, the pressure sensitive sealing area 264 is frangible, and the juxtaposed surfaces of the card 260 are not thereby disfigured when the blister 258 is removed. Moreover, the blister 258 can be resealed to the card 260 by reorienting the blister on the card so that components of the pressure sensitive peripheral seal 264 are rejoined.

It will be understood that the positions of the inner or pressure sensitive seal 264 and the outer or heat seal 262 can be interchanged. In that case, the outer score lines 268 would be omitted and inner score lines (not shown) would be extended about the inner periphery of the sealing flange 268 of the blister 258.

It will be understood that the tear-away packages of any of the preceeding Figures can be reclosed by one or more strips of pressure sensitive tape which can be temporarily adhered to a plastic-finished portion of the blister card, desirably at areas removed from the blister. The one or more strips of pressure sensitive tape can be readhered to the blister card when not in use. The reclosable feature of the invention is particularly desirable when the blister may contain two or more items which are not needed or used at the same time.

From package 272 of FIG. 11 it is evident that the tear-away blister package of the invention need not be square or rectangular. Oval blister 274 is secured to card 276 by means of a blister flange and heat seal denoted generally by the reference numeral 278. Inner and outer score lines 280, 282 are provided for tear-away capability, as in preceeding Figures. It will also be understood that the blister 274 can be of irregular or nongeometric contour (not shown). The latter consideration is applicable generally to the preceeding figures hereof, to the extent that any such irregular figure is consistent with the living hinge capability when employed.

Desirably, but not necessarily, each of the packages shown herein is provided with an opening finger tab, such as the tab 30 of Figure 1, the tab 56*b* of FIGS. 1B, 1C, 1F, 4A or the tab 57 of FIG. 4B. The term "finger tab" also includes use of a notch, such as the notch 54 of FIG. 4 or the notch 78 of FIGS. 6, 6A, whereby the juxtaposed portion of the blister flange serves as a finger tab. Where the opening side of the blister is removed from the card edge, as in FIG. 6C and other figures a hole or knockout 284 (FIG. 6C) can be made in the base card in provision of such "finger tab."

As employed herein, the term "score lines" denotes an actual scoring cut into the card or other base member to a plane of frangibility contained within the base member or card. In the case of "outer score lines" or "outward score lines," the term includes an adjacent edge portion or portions of the base member or card (depending on a particular location of the blister member), provided that such edge portion or portions are sufficiently juxtaposed to the outer periphery of the sealed area between the blister and the card to provide the tear-away feature of the invention, without defacing the base member or card to any substantial extent beyond the limits of the sealed area.

From the foregoing it will be seen that novel and efficient forms of Tear-Away Blister Package have been described herein. Although the several blister package configurations illustrated herein are rectangular, it will be understood that other regular or irregular configurations can be employed within the teachings of the invention. The descriptive and illustrative materials employed herein, therefore, are utilized for purposes of exemplifying the invention and not in limitation thereof. Accordingly, numerous modifications of the invention will occur to those skilled in the art without departing from the spirit and scope of the invention. Moreover, it is to be understood that certain features of the invention can be used to advantage without a corresponding use of other features thereof.

I claim:

1. A quick-open blister package comprising a base member having at least one layer, a blistered containment member peripherally secured to said base member, the material of said base member layer being internally frangible in directions parallel to sides of said layer, a series of inner score lines in said base member and extending at least partially about said blistered member and closely adjacent an outer periphery of a pocket thereof, a series of outer score lines in said base member spaced outwardly of said inner series and extending closely and at least partially about the blistered member outer periphery, said inner score lines and said outer score lines excepting any portion of said outer score lines at an edge of said base member layer being cut into a nearer side of said base member layer but terminating short of a far side of said base member layer, said blistered member being secured to said base member within that area thereof between said series of score lines, a substantial area of said base member extending laterally of said blistered member in at least one direction thereof for front printing and the like, said score lines essentially delineating a relatively narrow band of securance area on said base member and at least partially surrounding said blistered member pocket, at least the major proportions of said inner and said outer score lines respectively coextending about said blistered member for this purpose, and means for securing said blistered member to said base member at said securance area band, whereby on opening said package said blistered member and said securance area band can be displaced from said base member by tearing taking place entirely within said base member layer but only between said score lines.

2. The combination according to claim 1 wherein said delineated area is substantially wider than the peripheral securance of said blistered member to said base member to increase the opening forces of the package.

3. The combination according to claim 1 wherein said blistered member is provided with a peripheral securance flange, and said first and second score lines are aligned respectively with inner and outer edges of at least a portion of said flange for at least partial concealment of the score lines.

4. The combination according to claim 1 wherein said score lines are closely disposed to the securance of said blistered member to said base member to reduce the opening forces of the package.

5. The combination according to claim 1 wherein said blister is provided with a peripheral securance flange, and the peripheral securance of said blistered member to said base member and said score lines are disposed inwardly of the respective edges of said flange to reduce the opening forces of the package and at least partially to conceal the presence of said score lines.

6. The combination according to claim 1 wherein said blistered member is provided with a peripheral securance and sealing flange, and a fingerlift is formed integrally on a portion of said flange.

7. The combination according to claim 1 wherein a fingerlift is formed integrally with an end portion of a pocket area of said blistered member.

8. The combination according to claim 1 wherein said blistered member is provided with a peripheral securance flange, a portion of said flange being extended over an edge portion of said base member to provide a fingertab for opening said package.

9. The combination according to claim 1 wherein said blistered member is provided with a peripheral securance flange, and a portion of said flange is extended to a point or line overhanging an adjacent edge portion of said base member for opening said package.

10. The combination according to claim 1 wherein said base member is a laminated structure having a layer which is relatively more frangible than the remainder of said base member, said frangible layer substantially defining said plane of frangibility.

11. The combination according to claim 10 wherein said base member includes relatively thin layers of tear-resistant material disposed one on each side of said frangible layer.

12. A quick-open blister package comprising a base member having a frangible layer therewithin, a containment blister peripherally secured to said base member, inner and outer score lines cut in said base member substantially to the depth of said frangible layer, said score lines being spaced from one another and partially surrounding said blister, said blister having a peripheral securance flange with portions thereof juxtaposed to an area of said base member enclosed between said score lines, said juxtaposed flange portions being secured and continuously sealed to said base member but only at said enclosed area, said flange having a remaining portion secured and sealed to said base member outside of said enclosed area to form a "living" hinge upon opening of said package, said hinge and said enclosed area completely surrounding said blister.

13. The combination according to claim 12 wherein opening means are coupled to said flange at a location remote from said remaining flange portion.

14. The combination according to claim 1 wherein said blistered member is located within a central area of said base member and remote from the edges thereof, said outer series of score lines extending entirely about the blistered member periphery.

15. The combination according to claim 1 wherein said blistered member is disposed adjacent at least one edge of said base member, said outer series of score lines extending about a portion of said blistered member periphery removed from said edge.

16. The combination according to claim 1 wherein said base member is fabricated from an internally frangible material having a preselected frangibility less than that of the peripheral securance of said blistered member to said base member.

17. The combination according to claim 16 wherein said base member includes a cardboard material having a plastic material admixed therewith to increase the opening forces productive of tearing of said base member substantially along said plane.

18. The combination according to claim 1 wherein said base member is provided with an overlying heat-sealable plastic layer defining said plane of frangibility, said score lines penetrating said layer, and said blistered member being fabricated from a heat-sealable plastic and being heat-sealed to said plastic layer to secure said blistered member thereto and between said score lines as aforesaid so that a portion of said plastic layer is removed with said blistered member.

19. The combination according to claim 1 wherein said blistered member is provided with a securance flange, and opening initiating means are mounted on said package adjacent a portion of said flange.

20. The combination according to claim 19 wherein said flange portion in addition is provided with a suspending aperture extending through said package for minimizing theft of contents thereof upon suspending said package for display purposes.

21. The combination according to claim 19 wherein said opening initiating means include an unsecured portion of said flange portion remote from a containment portion of said blistered member.

22. The combination according to claim 18 wherein said blistered member is provided with a peripheral flange at least coextensive with that portion of said plastic layer between said score lines.

23. The combination according to claim 1 wherein said base member is substantially rigid.

24. The combination according to claim 1 including said outward series of score lines being discontinuous at a first-opened side of said blister for enhancement of a theft-resistant capability of said package.

25. The combination according to claim 1 including said blister member having a peripheral securance flange, a portion of said flange forming a living hinge upon opening of said package, at least said first series of score lines being discontinuous in the area of said living hinge.

26. The combination according to claim 1 wherein said blister member contains at least one additional pocket.

27. The combination according to claim 26 including a partition formed from said blistered member and extending between an adjacent pair of said pockets into flush but unsealed engagement with said base member, said inner score lines crossing the ends of said partition and extending about the nonadjacent sides of said pockets.

28. The combination according to claim 26 including a partition formed from such blistered member between a pair of said pockets, said partition being secured to said base member, said series of inner score lines being extended respectively about the outer peripheries of each of said pockets.

29. The combination according to claim 25 wherein an auxiliary pressure sensitive securance means is provided between said blistered member and said base member at a location remote from said living hinge, said auxiliary securance means being repetitively frangible for reclosability of said blistered member in cooperation with said living hinge, said auxiliary securance means being located outside of said securance area band.

30. The combination according to claim 1 including said securance band continuously surrounding said blistered member pocket, and frangible sealing means spaced from said securance area band and continuously surrounding said blistered member pocket for reclosability of said blistered member.

31. The combination according to claim 1 wherein said securing means include sealing means continuously surrounding said blistered member pocket.

32. The combination according to claim 18 including said heat sealing extending continuously and peripherally around said blister member pocket.

33. The combination according to claim 12 including said outer score lines completely surrounding said blister for tear-away capability of said flange portion and complete removability of said living hinge from said base member without defacement thereof.

34. The combination according to claim 1 wherein said base member layer is a gray cardboard material having a superficial layer of light cardboard material thereon and facing said blistered member, said score-lines penetrating through said superficial layer and into said gray cardboard material.

35. The combination according to claim 1 wherein said base member layer is a gray cardboard material having a superficial layer of heat-sealable plastic thereon and facing said blistered member, said score lines penetrating through said superficial layer and into said gray cardboard material, said blistered member being heat sealed to said plastic layer at areas thereof between said score lines.

36. The combination according to claim 34 wherein an additional layer of heat-sealable plastic is coated on said light cardboard material, said score lines penetrating through said plastic and said light cardboard layers and into said gray cardboard layer, said blistered member being heat-sealed to said plastic layer at areas between said score lines.

* * * * *